US005284333A

United States Patent [19]

Ishikawa

[11] Patent Number: 5,284,333

[45] Date of Patent: Feb. 8, 1994

[54] SHEET FEEDING APPARATUS

[75] Inventor: Noriyoshi Ishikawa, Yokohama, Japan

[73] Assignee: Canon Kabushiki Kaisha, Tokyo, Japan

[21] Appl. No.: 38,090

[22] Filed: Mar. 29, 1993

Related U.S. Application Data

[63] Continuation of Ser. No. 780,990, Oct. 24, 1991, abandoned.

[30] Foreign Application Priority Data

Oct. 26, 1990 [JP] Japan ..... 2-290359
Oct. 31, 1990 [JP] Japan ..... 2-294821

[51] Int. Cl.[5] ..... B65H 9/16
[52] U.S. Cl. ..... 271/22; 271/251; 271/253
[58] Field of Search ..... 271/251, 226, 248, 250, 271/253, 21, 22

[56] References Cited

U.S. PATENT DOCUMENTS

| | | | |
|---|---|---|---|
| 1,708,157 | 4/1929 | Spiess . | |
| 2,464,173 | 3/1949 | Broadmeyer | 271/251 |
| 2,767,982 | 10/1956 | Noon | 271/251 |
| 2,819,078 | 1/1958 | Durand | 271/251 X |
| 3,666,262 | 5/1972 | Fowler et al. | 271/52 |
| 3,929,327 | 12/1975 | Olson | 271/250 |
| 3,980,296 | 9/1976 | Craft | 271/251 |
| 4,056,263 | 11/1977 | Lawhite | 271/251 X |
| 4,072,305 | 2/1978 | Scheid | 271/251 X |
| 4,098,551 | 7/1978 | Komori et al. | 355/3 R |
| 4,374,586 | 2/1983 | Lamos et al. | 271/37 |
| 4,426,073 | 1/1984 | Mizuma | 271/251 |
| 4,432,541 | 2/1984 | Clark et al. | 271/251 |
| 4,482,147 | 11/1984 | Hibi | 271/251 X |
| 4,877,234 | 10/1989 | Mandel | 271/225 |
| 4,955,965 | 9/1990 | Mandel | 271/225 |

FOREIGN PATENT DOCUMENTS

| | | |
|---|---|---|
| 0127479 | 12/1984 | European Pat. Off. . |
| 0184263 | 6/1986 | European Pat. Off. . |
| 56-113641 | 9/1981 | Japan . |
| 57-90344 | 6/1982 | Japan . |
| 58-26741 | 2/1983 | Japan . |
| 58-31844 | 2/1983 | Japan . |
| 58-109344 | 6/1983 | Japan . |
| 58-109345 | 6/1983 | Japan . |
| 62-136454 | 6/1987 | Japan . |
| 63-00043 | 12/1988 | Japan . |
| 64-81742 | 3/1989 | Japan . |

OTHER PUBLICATIONS

Kroeker, "Cone Roller Couple", 25 IBM Technical Disclosure Bulletin (Mar. 1983).
Lamos, "Aligning Sheet Feeder", 20 IBM Technical Disclosure Bulletin (Sep. 1977).

*Primary Examiner*—Richard A. Schacher
*Attorney, Agent, or Firm*—Fitzpatrick, Cella, Harper & Scinto

[57] ABSTRACT

A sheet feeding apparatus comprising a feeding device for feeding a sheet, a regulating member for regulating a position of a lateral edge of the sheet fed by the feeding device, a first rotary member adapted to feed the sheet fed by the feeding device while urging the lateral edge of the sheet against the regulating member, a second rotary member adapted to feed the sheet fed by the first rotary member while urging the lateral edge of the sheet against the regulating member, and a guide device for guiding the sheet in such a manner that the sheet is curved between the feeding device and the first rotary member. An urging force of the first rotary member by which the sheet is urged against the regulating member is set to be equal to or smaller than an urging force of the second rotary member by which the sheet is urged against the regulating member.

34 Claims, 9 Drawing Sheets

33
FS2
FS1
Pa
26
25
P
FS2
(FS2>FS1)
FG'
M
FH'
Δ'
FG
FEED DIRECTION
FH
Δ

SHEET FEEDING APPARATUS

This application is a continuation of application Ser. No. 07/780,990 filed Oct. 24, 1991, now abandoned.

BACKGROUND OF THE INVENTION

1. Field of the Invention

The present invention relates to a sheet feeding apparatus used with an image forming system such as a copying machine, printer, facsimile, word processor and the like, or other equipments utilizing sheets. More particularly, it relates to a sheet feeding apparatus for feeding a sheet (transfer sheet, photosensitive sheet, electrostatic recording sheet, print sheet, OHP sheet, envelope, post card, sheet original or the like) rested in a sheet containing portion such as a sheet supply cassette one by one to a sheet receiving portion such as an image forming station, exposure station, treating station or the like with a one-side reference.

2. Related Background Art

For convenience' sake, the related art will be described with reference to examples of laser beam printers shown in FIGS. 11A to 11C.

FIGS. 11A, 11B and 11C show laser beam printers having sheet paths, i.e., sheet feeding paths (extending from a sheet containing portion to a sheet ejecting portion) of straight type, U-shaped type and S-shaped type, respectively.

The printer having the sheet path of straight or linear type as shown in FIG. 11A has a sheet supply cassette inlet 51 formed in a side surface of a frame 50 of the printer, and a sheet ejection opening 62 formed in the other side surface of the frame. A sheet supply cassette (sheet containing portion) 52 is mounted within the inlet 51, and an ejection tray 63 is mounted within the ejection opening 62 and extends outwardly therefrom. When a sheet supply signal is emitted, a sheet supply roller 53 is rotated to afford a feeding force to an uppermost sheet (recording medium) P on a sheet stack rested in the sheet supply cassette 52, thereby separating the uppermost sheet from the other sheets with the aid of separating pawls 54 and feeding the sheet into the printer.

The fed sheet is conveyed between guide plates 55, 56 and through a path (sheet path) including a pair of register rollers 57, on image transferring portion 58, a conveyer belt device 59, an image fixing device 60, ejector rollers 61 and the ejection opening 62, whereby the sheet on which an image was formed (print) is ejected on the ejection tray 63.

An electrophotographic photosensitive member of drum type (referred to as "photosensitive drum" hereinafter) 64 is driven at a predetermined peripheral speed (process speed) around its own axis in a clockwise direction and is provided at its peripheral surface with a photosensitive body consisting of an organic or inorganic photoconductive layer. The reference numeral 65 denotes a charger for uniformly charging the peripheral surface of the photosensitive drum with the predetermined potential having a predetermined polarity; 66 denotes a beam scanner for scanning and exposing the charged surface of the photosensitive drum to write the aimed information thereon; 66*a* denotes a beam reflection mirror; 67 denotes a developing device for developing, with toner, an electrostatic latent image formed on the drum surface by the exposure; 68 denotes a transfer roller acting as a transfer means for transferring the toner image on the drum surface to the recording sheet P; and 69 denotes a cleaning device for cleaning the drum surface after the toner image is transferred to the recording sheet.

Since the principle and process for forming the image is well known, the explanation thereof will be omitted. Incidentally, in the illustrated printer, the photosensitive drum 64, charger 65, developing device 67 and cleaning device 69 are constituted as a single removable process cartridge 70.

In this printer, the sheet path extending from the sheet supply cassette 52 to the ejection tray (sheet ejecting portion) 63 is substantially straight, so that the reliability of the sheet feeding operation is increased. However, since the sheet supply cassette 52 and the sheet ejection tray 63 are protruded from both sides of the printer frame outwardly, the installation space for the printer will be greatly increased.

In order to reduce the substantial installation space of a printer, there has been proposed laser beam printers having sheet paths of U-shaped type or S-shaped type, as shown in FIG. 11B or FIG. 11C.

The printer having the sheet path of U-shaped type as shown in FIG. 11B has a sheet supply cassette inlet 51 and a sheet ejection opening 62 and is designed so that a sheet supply cassette 52 is wholly inserted into the printer from the inlet 51 and a recording sheet P supplied from the cassette by means of a sheet supply roller 53 is inverted by inversion guides 71*a*, 71*b* and convey rollers 72*a*, 72*b* to direct the sheet toward a direction opposite to a sheet feeding direction from the cassette 52 above the latter and is fed through a path including an image transferring portion 58, a conveyer belt device 59, an image fixing device 60, ejector rollers 61 and the ejection opening 62 and then is ejected onto an ejection tray 63. With this arrangement, since only the ejection tray 63 is protruded from the printer outwardly, the installation space for the printer is reduced in comparison with that for the printer of FIG. 11A.

On the other hand, the printer having the sheet path of S-shaped type as shown in FIG. 11C is designed similar to the printer of FIG. 11B, but the sheet ejected from the ejector rollers 61 is inverted again upwardly by an invertion guide 73 to be ejected onto an ejection tray 75 formed on a top plate of the printer by means of second ejector rollers 74. With this arrangement, since there is no member or element protruding from the printer outwardly, the installation space for the printer is further reduced in comparison with that for the printer of FIG. 11B.

Although the installation space for the printer can be reduced by forming the sheet path as the U-shaped configuration (FIG. 11B) or S-shaped configuration (FIG. 11C), the height of the printer will be increased in comparison with that of the printer having the straight sheet path as shown in FIG. 11A. To eliminate this drawback, there has been proposed to reduce the radii of the inversion guides as long as possible.

However, if the radii of the inversion guides are reduced, for example, in an inverting portion C in FIG. 11B, the sheet will be clogged or slacked between the inversion guides 71*a*, 71*b* due to the difference in speed between the convey rollers 72*a*, 72*b*, thus worsening the reliability of the feeding operation. Further, in the image forming system, when the recording sheet is not properly fed to the recording portion, the image formed on the recording sheet will be distorted.

Thus, there has been proposed that the sheet was fed by skew-feed rollers so that one lateral edge of the sheet was guided along a one-side feeding reference formed in an image forming system to prevent the skew-feed of the sheet. However, if the radii of the inversion guides for inverting the sheet are decreased, the skew-feed of the sheet will occur at the first skew-feed roller due to the feeding load in the inversion guide at a side opposite to the feeding reference side, thus damaging the edge of the sheet abutted against the one-side feeding reference.

Further, in view of the manufacturing technique, it is very difficult to completely coincide a position of a regulating member (formed on a sheet supply cassette) for regulating a lateral edge (at the reference side) of a recording sheet with a position of a feeding reference guide formed on an image forming system, with the result that the recording sheet will frequently be damaged. Explaining such inconvenience with reference to FIG. 12A, when the position of the regulating member 89 is deviated from the position of the feeding reference guide 90 by a distance $\Delta_1$, as the recording sheet 92 is fed while being biased toward a direction shown by the arrow by means of the skew-feed roller 91, the lateral edge of the sheet 92 will be bent or scratched at a position B in FIG. 12A.

On the other hand, as shown in FIG. 12B, when the feeding reference guide 90 is displaced inwardly from the position of the regulating member 89 by a distance $\Delta_2$, a corner of a leading end of the recording sheet 92 will be struck against the feeding reference guide 90 at a position C in FIG. 12C, thus scratching that corner.

SUMMARY OF THE INVENTION

Accordingly, an object of the present invention is to provide a sheet feeding apparatus which can correctly feed a sheet without any skew-feed of the sheet by feeding the sheet while abutting one lateral edge of the sheet against a one-side feeding reference with a simple construction and which can feed the sheet without any skew-feed of the sheet and the damage of a lateral edge of the sheet even when the radius of an inversion path for inverting the sheet is relatively small.

Another object of the present invention is to provide a sheet feeding apparatus for an image forming system, which does not generate the excessive tension or slack in a sheet that may worsen the reliability of the feeding of the sheet even when the radius of an inversion path for inverting the sheet is made smaller in order to reduce the height of the image forming system, and which does not bent. and/or damage the sheet by a regulating member even when a position of the regulating member on a sheet supply cassette is deviated from a position of a feeding reference guide on the image forming system.

DETAILED DESCRIPTION OF THE PREFERRED EMBODIMENTS

Figure 1:
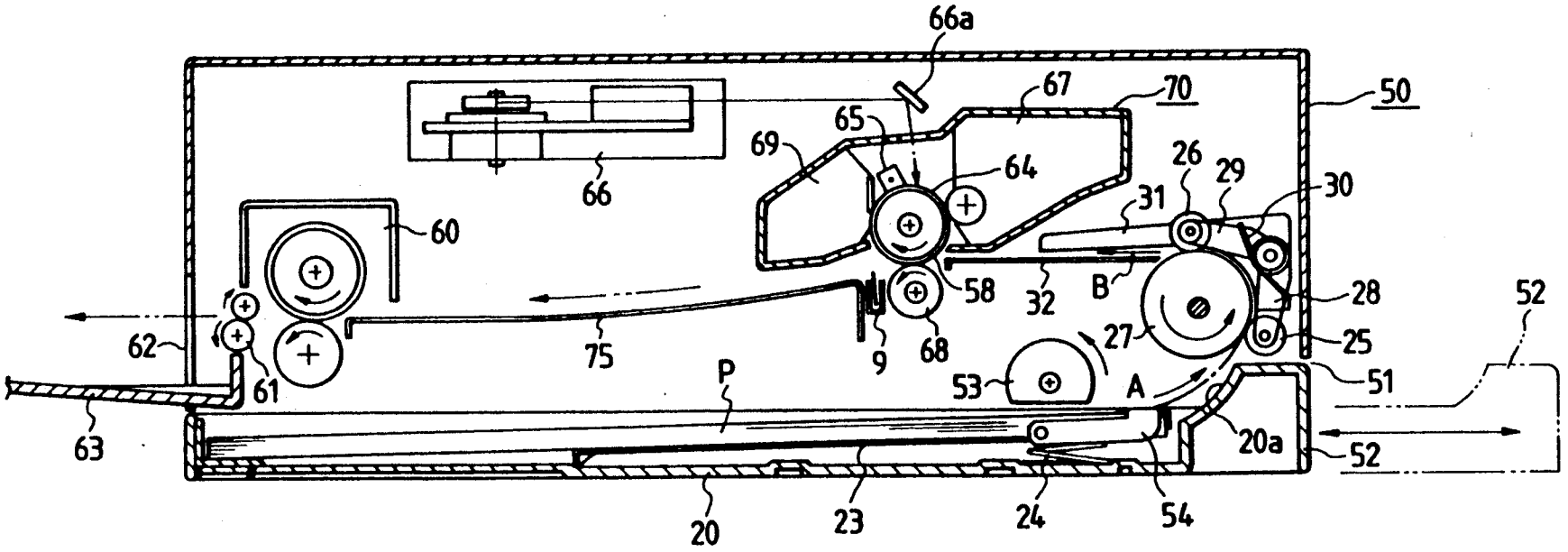
FIG. 1 is an elevational sectional view of an image forming system incorporating a sheet feeding apparatus according to the present invention therein.
Figure 2:
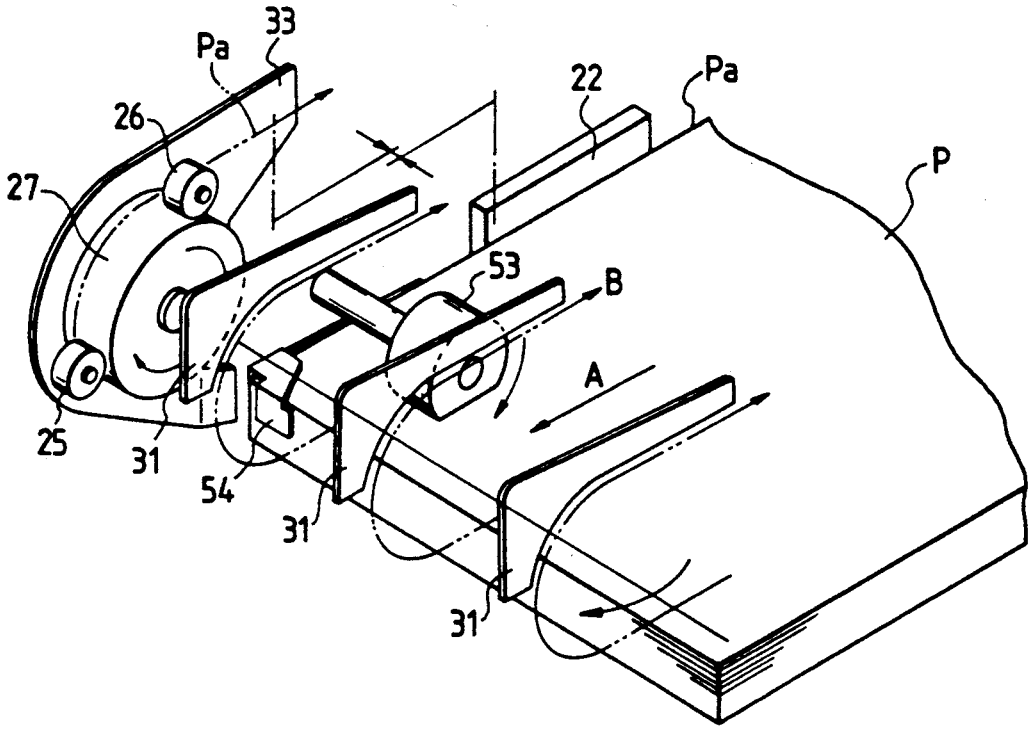
FIG. 2 is a perspective view of a sheet inverting portion of the sheet feeding apparatus.
Figure 11A:
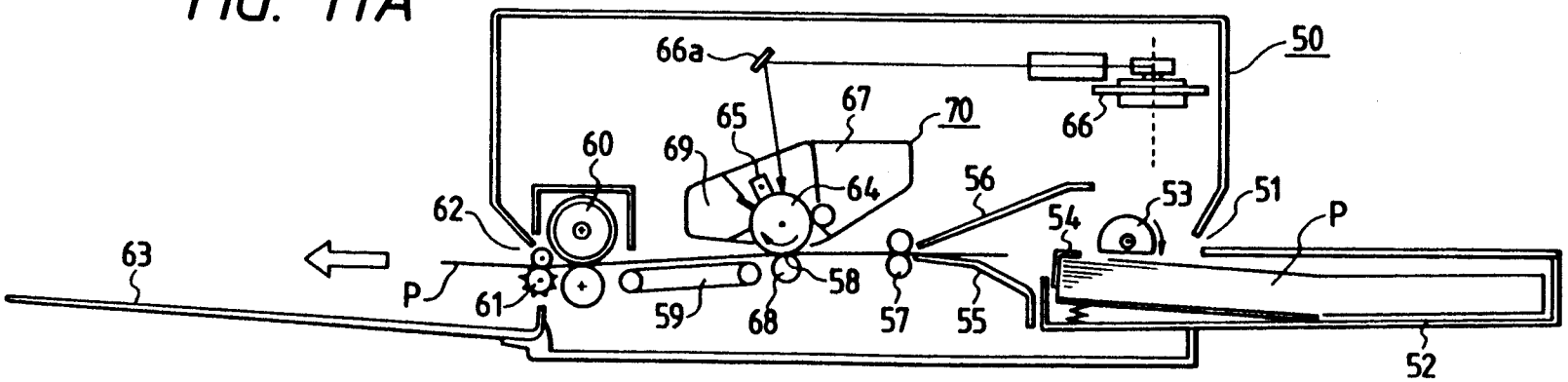
FIGS. 11A, 11B and 11C are elevational sectional views of image forming systems having sheet paths of straight type, U-shaped type and S-shaped type, respectively.
Figure 11B:
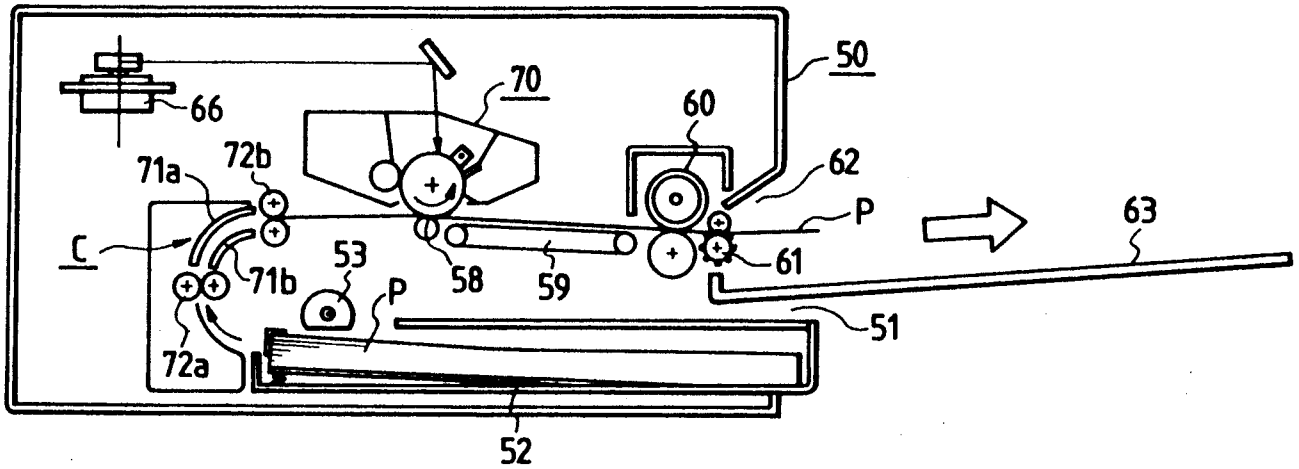
Figure 11C:
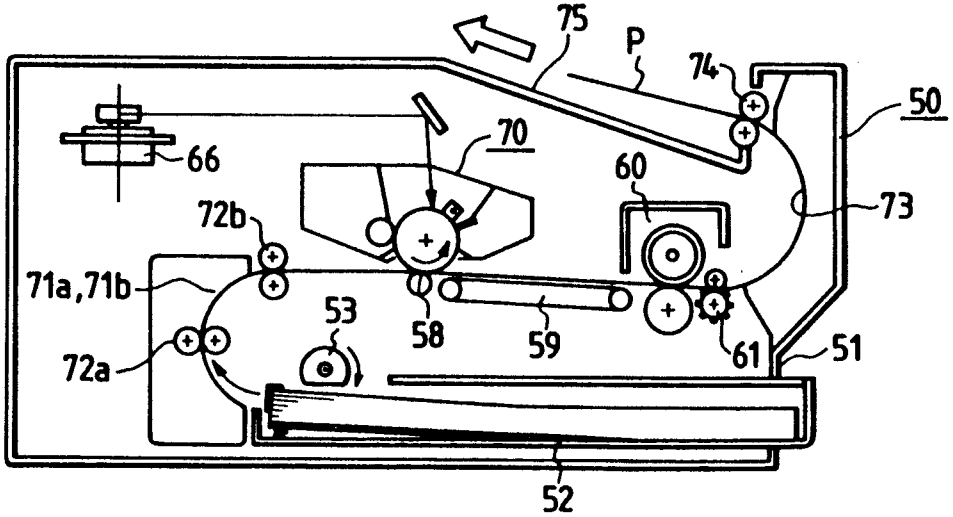

FIG. 1 shows, in an elevational section, an example of a laser beam printer (image forming system) incorporating a sheet feeding apparatus according to a preferred embodiment of the present invention, and FIG. 2 is a perspective view of a sheet inverting portion of the sheet feeding apparatus. Constructural members or elements same as or similar to those of the printer described in connection with FIG. 11 are designated by the same reference numerals, and the detailed explanation thereof will be omitted.

A sheet supply cassette 52 comprises a cassette housing 20, an intermediate plate 23 biased upwardly by means of a compression spring 24, sheet separating pawls 54, and a sheet edge regulating member 22 (FIG. 2) for guiding one lateral edge of a recording sheet P. The recording sheets P stacked in the sheet supply cassette 52 are separated by a feeding force directing to the right (FIG. 1) and applied to an uppermost sheet on the sheet stack due to the rotation of a sheet supply roller 53 in such a manner that only the uppermost sheet is separated from the other sheets by means of the separating pawls 54. The separated sheet is fed in the right direction shown by the arrow A. In this case, the recording sheets P are being urged against the sheet supply roller 53 with a predetermined pressure by the action of the intermediate plate 23 and the compression spring 24.

The separated sheet P is fed by rightwardly and upwardly along an upper guide **20*a* of the sheet supply cassette 52 to be entered between a feed roller 27 and a first skew-feed roller (first urging means) 25. Then, the recording sheet P is fed in synchronous with a rotation speed from a drive source (not shown) so that the sheet is advanced along an inversion guide 31 and is passed between the feed roller 27 and a second skew-feed roller (second urging means) 26. As a result, the sheet P is inverted to be fed in a direction B opposite to the feeding direction A from the cassette 52. The inverted recording sheet P is then passed through a path including a guide plate 32, an image transferring portion 58, a guide plate 75, an image fixing device 60, ejector rollers 61 and a sheet ejection opening 62, and is lastly ejected onto an ejection tray 63 disposed at the left side of a frame 50** of the system.

The transferring of a toner image from a surface of a photosensitive drum 64 to the recording sheet P can be effected by the fact that a back surface of the recording sheet P is charged by means of a transfer roller 68 with a charge polarity opposite to that of the toner image. And, the recording sheet P passed through the image transferring portion 58 is separated from the surface of the photosensitive drum 64 by removing the charge from the sheet by means of a separating and discharging probe 9.

In FIG. 2, the reference numeral 33 denotes a one-side feeding reference guide for the recording sheet P supplied from the sheet supply cassette 52, which reference guide is provided on the image forming system. The feed roller 27 is disposed adjacent to the one-side feeding reference guide.

Figure 3A:
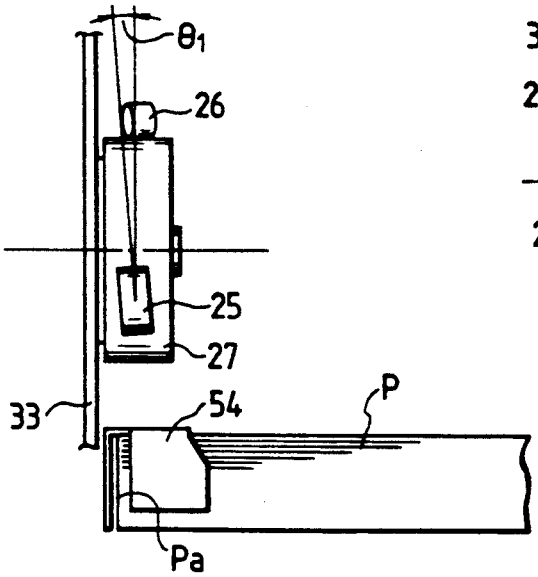
FIGS. 3A and 3B are elevational and plan views, respectively, showing a feed roller and a skew-feed roller.
Figure 3B:
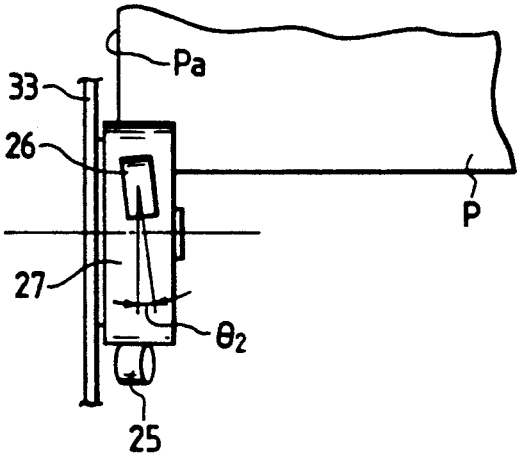

The first and second skew-feed rollers 25, 26 are urged against the feed roller 27 by means of first and second skew-feed arms 28, 29 (FIG. 1) and a compression spring 30 (FIG. 1) at skew-feeding angles $\theta_1$ (=1°), $\theta_2$ (=4°), as shown in FIGS. 3A and 3B, respectively, so that a feeding reference lateral edge Pa of the recording sheet P supplied from the sheet supply cassette 52 is abutted against the surface of the one-side feeding reference guide 33.

Figure 4:
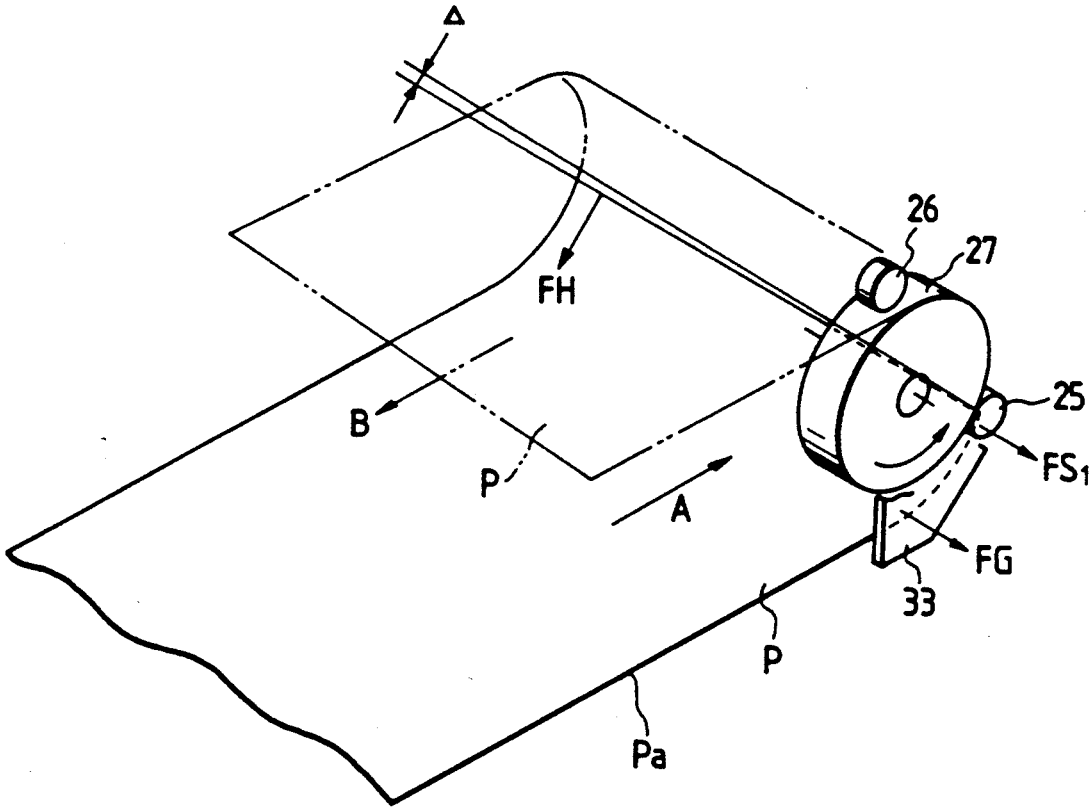
FIG. 4 is a perspective view of the feed roller and the skew-feed roller.
Figures 5A, 5B, 5C:
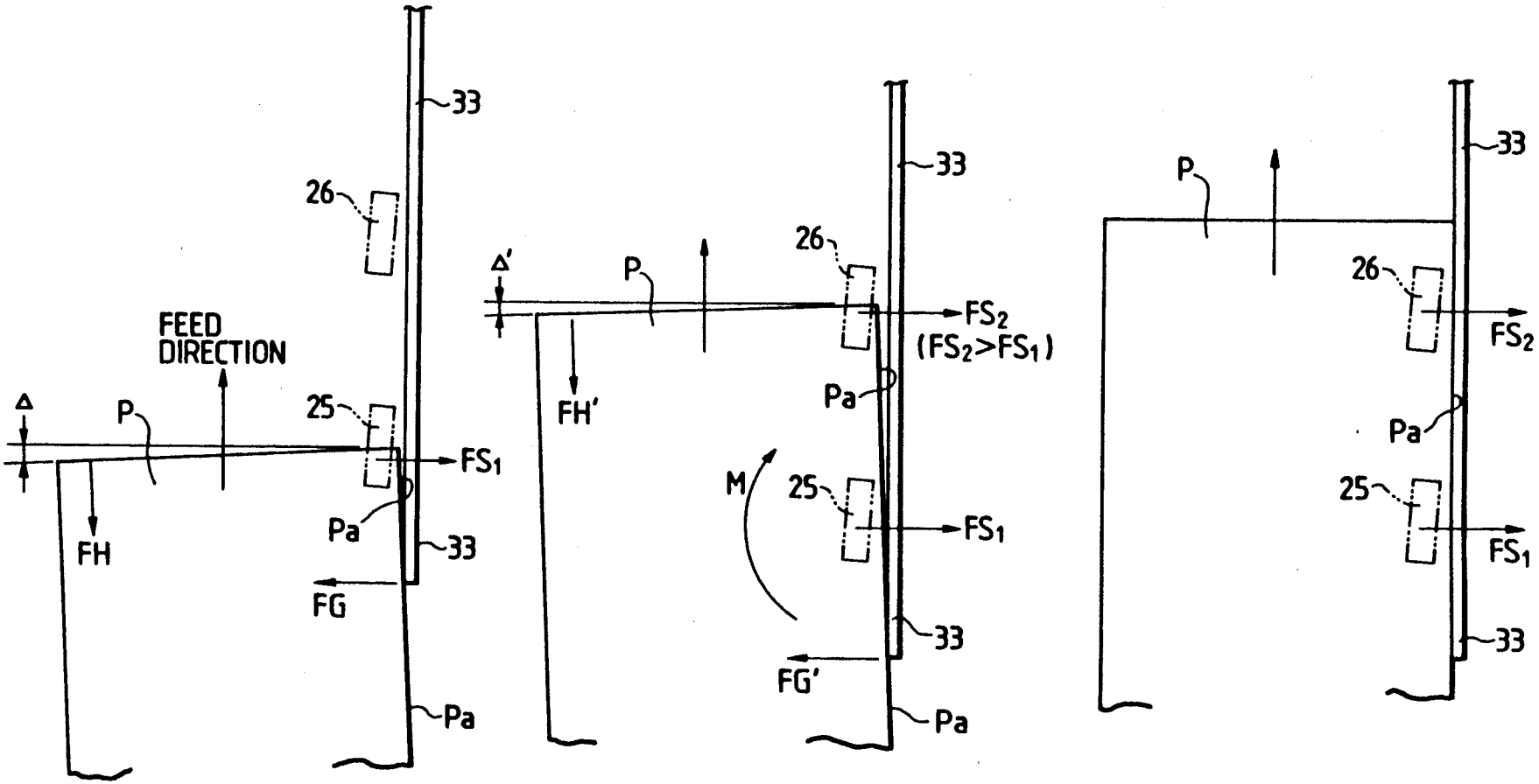
FIGS. 5A to 5C are development views showing the feeding of the sheet at the sheet inverting portion.

By selecting the skew-feeding angle of the first skew-feed roller 25 to be smaller than that of the second skew-feed roller 26 in this way, as shown in FIG. 4 (perspective view of the sheet inverting portion) and FIGS. 5A to 5C (development views of a sheet feeding path at the sheet inverting portion), the excessive skew-feeding force is not applied to the recording sheet P. Thus, by a combination of a feeding load FH due to the friction between the inversion guide 31 and a leading end of the recording sheet P and a skew-feeding force FS1 generated by the first skew-feed roller 25, a reaction force Fg acting between the recording sheet P and the one-side feeding reference guide 33 can be reduced, with the result that the recording sheet P can be fed without damaging the feeding reference lateral edge Pa of the sheet (FIG. 5A).

Further, as shown in FIG. 5B, when the recording sheet P reaches the second skew-feed roller 26, since the skew-feeding angle of the second skew-feed roller 26 is relatively great, an adequate skew-feeding force FS2 is applied to the recording sheet P by the second skew-feed roller 26, so that the lateral edge Pa of the recording sheet P is immediately and uniformly abutted against the feeding reference guide 33 by a momental force M around the first skew-feed roller 25 (FIGS. 5B and 5C).

After the lateral edge Pa of the recording sheet P is uniformly abutted against the feeding reference guide 33 (FIG. 5C), the recording sheet P is stably skew-fed while maintaining the uniform abutment between the sheet and the reference guide, by the combination of the skew-feeding force FSl of the first skew-feed roller 25 and the skew-feeding force FS2 of the second skew-feed roller 26.

Incidentally, Δ, Δ' indicate amounts of the delay in the feeding of the sheet P at a non-reference side with respect to the reference side, which are generated by the feeding loads FH, FH' due to the inversion guide 31.

So long as the relative relation between the skew-feeding angle of the first skew-feed roller 26 and that of the second skew-feed roller 26 is maintained, the skew-feeding angle $\theta_1$ of the first skew-feed roller 25 may fall within a range between 0° to 4°, and the skew-feeding angle of the second skew-feed roller 26 may fall within a range between 0° to 10°. Incidentally, the skew-feed rollers 25, 26 acting as the urging means are not limited to two in number, but three or more skew-feed rollers may be used. Further, the sheet feeding force may be applied to the skew-feed rollers 25, 26, rather than the feed roller 27.

Figure 6:
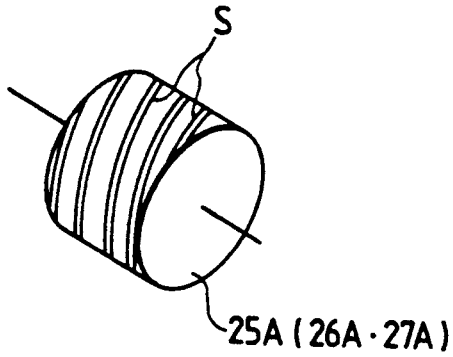
FIG. 6 is a perspective view of a feed roller or a skew-feed roller having spiral grooves at its peripheral surface.

In the illustrated embodiment, while the skew-feed rollers 25, 26 were used as the urging means for skew-feeding the sheet, as shown in FIG. 6, a feed roller 27A or skew-feed rollers 25A, 26A having spiral grooves S at its peripheral surface may be used to skew-feed the sheet toward the oneside feeding reference guide. Further, while the separating pawls were used to separate the sheet one by one, other sheet separating means may be used. Furthermore, the sheet containing portion is not limited to the sheet supply cassette, but may comprise a sheet supply deck, manual sheet supply platform or tray. In addition, the sheet may be proposed by sequentially cutting a sheet having a required length from a sheet roll.

Next, another embodiment of the present invention will be explained with reference to the accompanying drawings.

Figure 7:
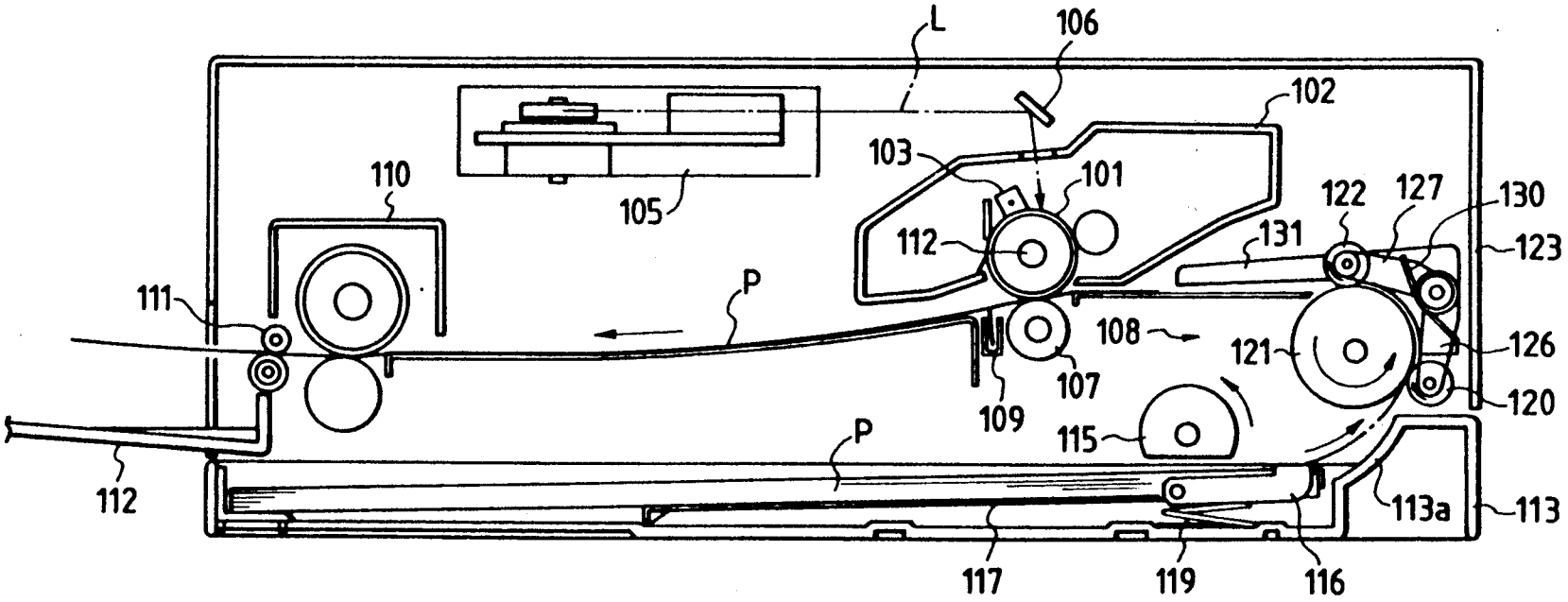
FIG. 7 is an elevational sectional view of a laser beam printer incorporating a sheet feeding apparatus according to another embodiment of the present invention therein.

FIG. 7 shows an electrophotographic laser beam printer (LBP) incorporating a sheet feeding apparatus according to another embodiment of the present invention therein.

In FIG. 7, an electrophotographic photosensitive member of drum type (referred to as "photosensitive drum" hereinafter) 101 is housed in a process cartridge 102 and is driven at a predetermined peripheral speed around its own axis 101*a*, and is provided at its peripheral surface with a photosensitive body consisting of an organic or inorganic photo-conductive layer.

During the rotation of the photosensitive drum 101, it is uniformly charged with a predetermined positive or negative potential by means of a primary charger (not shown) disposed in the process cartridge 102, and then, the aimed image information is written on the photosensitive drum at an exposure portion 103 by a scanning and exposure laser beam L from a laser scanner 105. As a result, electrostatic latent images corresponding to the aimed image information are sequentially formed on the peripheral surface of the photosensitive drum 101.

The reference numeral 106 denotes a reflection mirror for deflecting the laser beam L emitted from the laser scanner 105 toward the exposure portion 103 on the photosensitive drum 101.

The latent image carried on the photosensitive drum is then visualized with visualizing agent (toner) by means of a developing device (not shown) disposed in the process cartridge 102 to obtain a toner image. Then, when the toner images on the photosensitive drum sequentially reach a transfer station including a transfer roller 107, the toner images are sequentially transferred onto a transfer sheet (recording medium) P fed between the transfer roller 107 and the photosensitive drum 101 by means of a sheet supply mechanism 108.

The transferring of each toner image on the photosensitive drum to the transfer sheet P is effected by charging the sheet with the charge polarity opposite to that of the toner image by means of the transfer roller 107 disposed at a back side of the transfer sheet P. After passing through the transfer roller 107, the transfer sheet P is separated from the photosensitive drum by removing the charge from the sheet by means of a separating and discharging probe 109 charged with the charge polarity opposite to that of the transfer roller 107. The separated transfer sheet is then sent to a fixing device 110, where a non-fixed toner image transferred to the transfer sheet P is permanently fixed to the sheet. Thereafter, the transfer sheet P on which the image was fixed is fed by a pair of ejector rollers 111 and is ejected onto an ejection tray 112.

On the other hand, after the toner image has been transferred onto the transfer sheet, the photosensitive drum is cleaned by a cleaning device (not shown) disposed in the process cartridge 102 to remove the residual toner from the surface of the drum, thus preparing for the next image formation.

Figure 8:
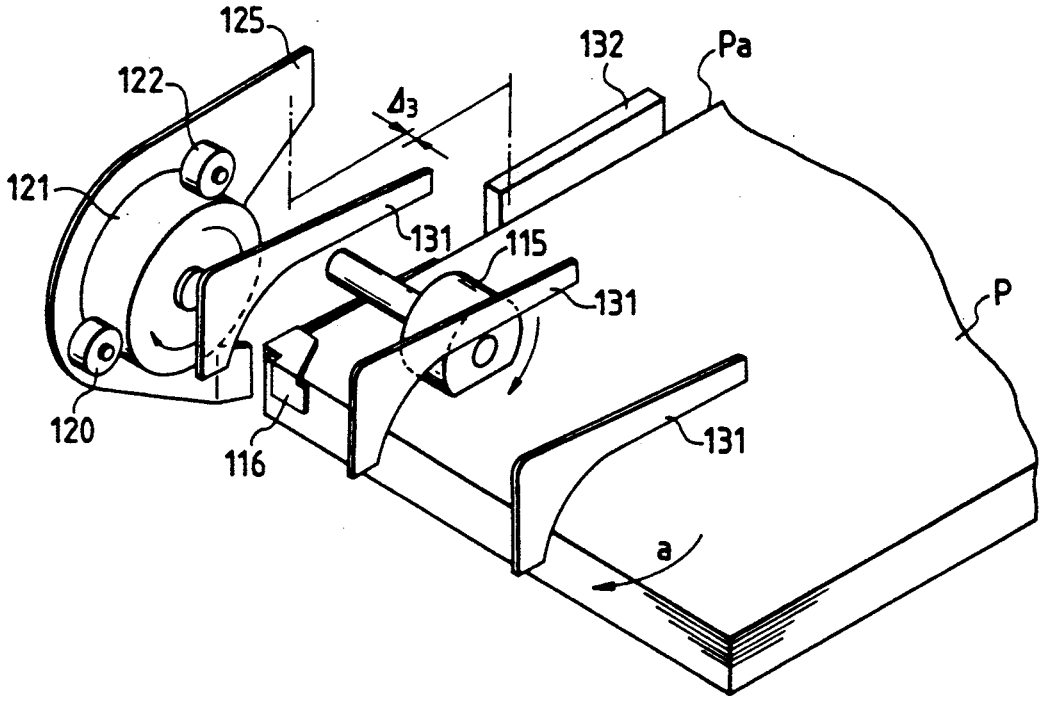
FIG. 8 is an enlarged perspective view of the sheet feeding apparatus of FIG. 7.

Next, the sheet feeding apparatus according to another embodiment of the present invention will be fully described with reference to FIG. 8.

Recording sheets P stacked in a sheet supply cassette 113 which is removably mounted within an image forming system are separated by a feeding force applied to an uppermost sheet on the sheet stack due to the rotation of a sheet supply roller 115 in such a manner that only the uppermost sheet is separated from the other sheets by means of the separating pawls 116. The separated sheet is fed in the right direction shown by the arrow a. In this case, the recording sheets P are being urged against the sheet supply roller 115 with a predetermined pressure by the action of an intermediate plate 117 and a compression spring 119.

The separated sheet P is fed by rightwardly and upwardly along an arcuted guide 113*a* of the sheet supply cassette 113 to be entered between a feed roller 121 and a first skew-feed roller 120. Then, the recording sheet P is fed in synchronous with a rotation speed from a drive source (not shown) so that the sheet is passed between the feed roller 121 and a second skew-feed roller 122 to reach an image forming portion between the photosensitive drum 101 and the transfer roller 107. When the transfer sheet P is fed around a peripheral surface of the feed roller 121, it is inverted by the radius of the feed roller 121. In this case, the other portions of the transfer sheet P are guided by an inversion guide 131.

Figure 9:
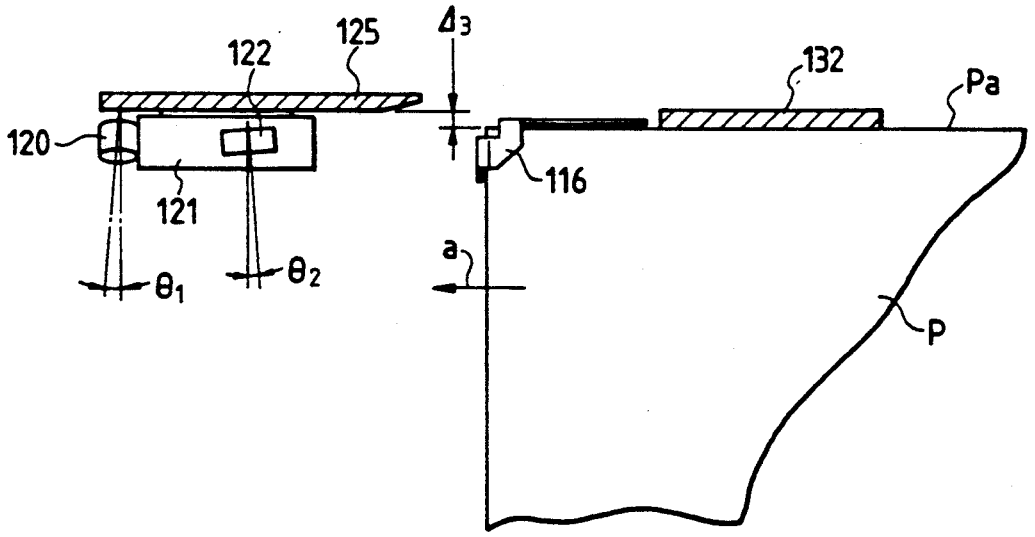
FIG. 9 is an enlarged plan view of the sheet feeding apparatus of FIG. 7.

As shown in FIG. 9, the first and second skew-feed rollers 120, 122 are urged against the feed roller 121 with predetermined pressures by means of first and second skew-feed arms 126, 127 (FIG. 7) and a compression spring 130 (FIG. 7) at skew-feeding angles $\theta_1$ (=1°), $\theta_2$ (=4°), respectively, so that a feeding reference lateral edge Pa of the recording sheet P is abutted against the surface of the one-side feeding reference guide 125 formed on a frame 123 of the printer (image forming system).

As shown in FIG. 9, a position of the feeding reference guide 125 is deviated from a position of an edge regulating member 132 formed on the sheet supply cassette 113 by a distance $\Delta$ (=1.5 mm).

Figure 10:
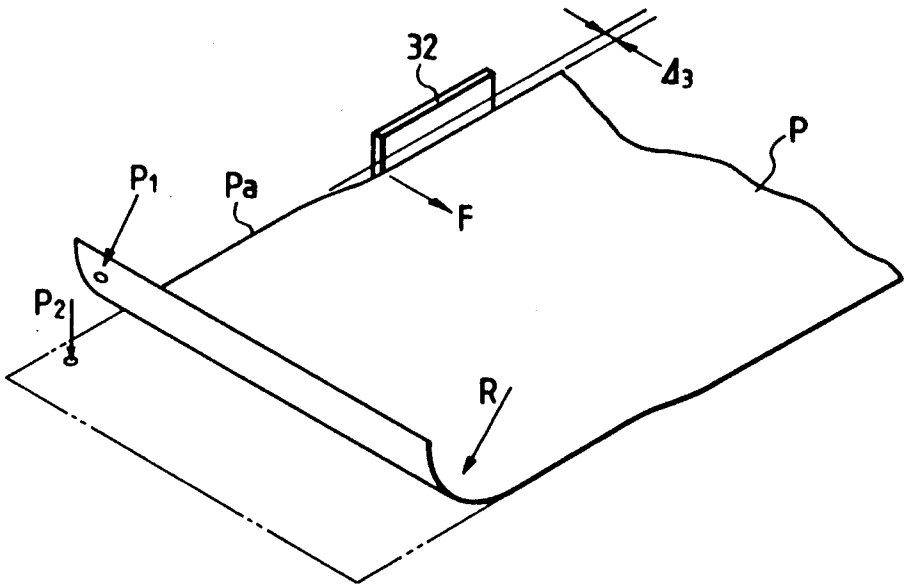
FIG. 10 is a perspective view showing the feeding of a transfer sheet fed by the sheet feeding apparatus of FIG. 7.

With this arrangement, according to the sheet feeding apparatus of this embodiment, even when there is the clearance $\Delta_3$ between the feeding reference guide 125 of the printer frame 123 and the edge regulating member 132 of the sheet supply cassette 113, the recording sheet P can be prevented from being bent or scratched, because, as shown in FIG. 10, even if the recording sheet P is pinched and caught between the first skew-feed roller 120 and the feed roller 121 at a position $P_1$, since the recording sheet P has a radius R of curvature, it is possible to absorb the clearance $\Delta_3$ by this radius R, thus reducing a force F of the regulating member 132 of the sheet supply cassette 113 acting on the lateral edge of the recording sheet P. If the recording sheet P is straightened so that it is caught at a position $P_2$, the resiliency of the recording sheet P will be stronger and the force F will be increased sufficient to damage the lateral edge of the recording sheet P, thus bending or folding and/or scratching the sheet.

Figure 12A:
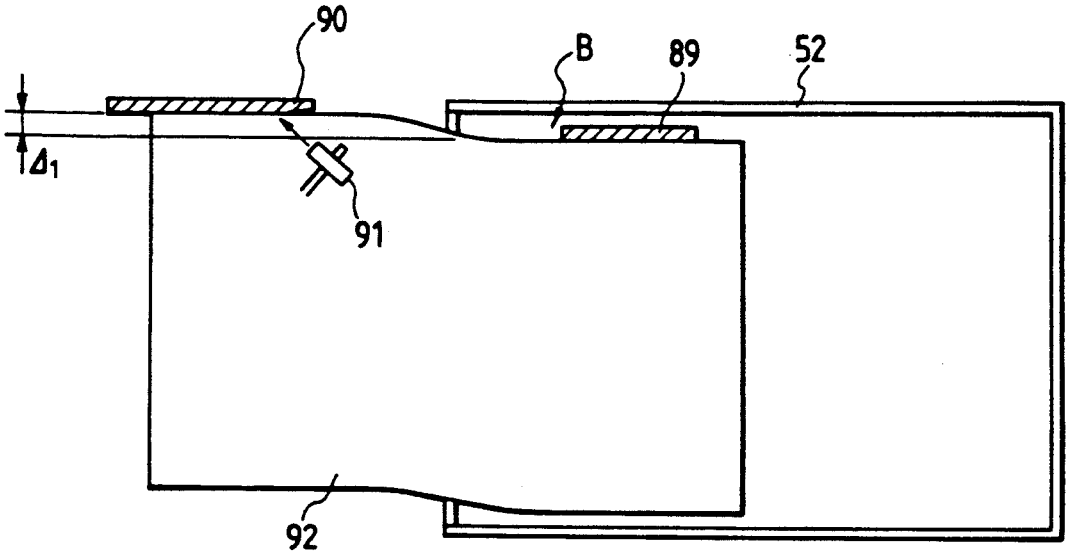
FIGS. 12A and 12B are plan views showing a relation between a regulating member and a feeding reference guide.
Figure 12B:
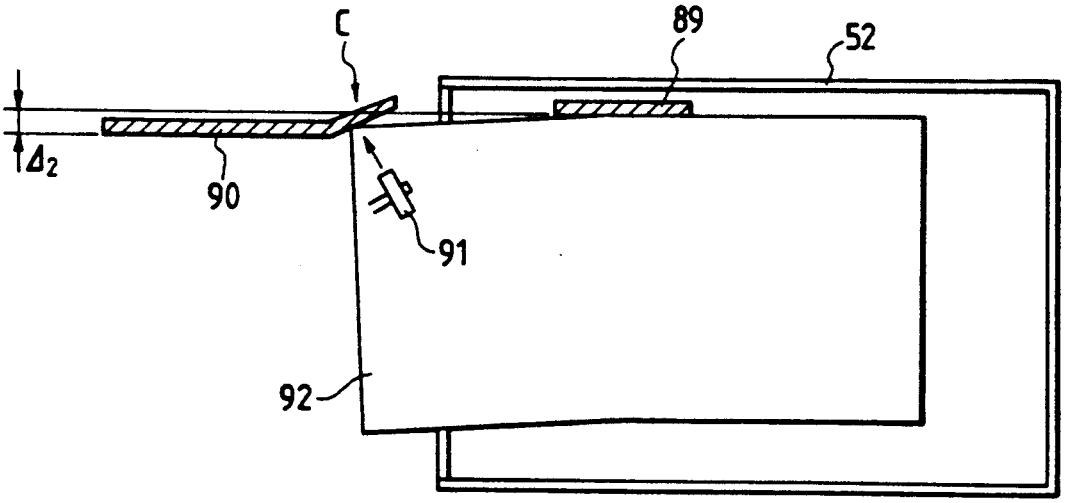

Further, in this embodiment, since the feeding reference guide 125 of the printer frame 123 and the edge regulating member 132 of the sheet supply cassette 113 have no positional relation as shown in FIG. 12B, the corner of the recording sheet P is not bent or folded at the position C (FIG. 12B). Further, since the inversion of the recording sheet P is effected on the peripheral surface of the single feed roller 121, during the inversion of the sheet, the feeding speed of the sheet is constant. Thus, there is no tension and slack in the recording sheet P.

Incidentally, in the illustrated embodiment, while the separating pawls were used as the separating means, it should be noted that other separating means may be used. Further, although the skew-feed rollers 120, 122 are used as the urging means for skew-feeding the recording sheet P, these skew-feed rollers may be provided at their peripheral surfaces with spiral grooves S as shown in FIG. 6. Such spiral grooves may be provided on the feed roller 121.

Further, the skew-feed rollers 120, 122 acting as the urging means are not limited to two in number. In addition, the feeding force for the recording sheet P may be applied to the skew-feed rollers 120, 122, rather than the feed roller 121. Further, while the clearance $\Delta_3$ between the feeding reference guide 125 of the printer frame 113 and the edge regulating member 132 of the sheet supply cassette 113 was set to have a value of 1.5 mm, for example, even when the clearance is set to have a value of 0 to 8 mm, it was found that the sheet can be properly fed without bending and scratching the sheet P.

What is claimed is:

1. A sheet feeding apparatus, comprising:

a feeding means for feeding a sheet;

a regulating member for regulating a position of a lateral edge of the sheet fed by said feeding means;

a first rotary member disposed at a downstream side of said feeding means in a sheet feeding direction and adapted to feed the sheet fed by said feeding means while urging said lateral edge of the sheet against said regulating member;

a second rotary member disposed at a downstream side of said first rotary member in the sheet feeding direction and adapted to feed the sheet fed by said first rotary member while urging said lateral edge of the sheet against said regulating member; and a guide means for guiding the sheet in such a manner that the sheet is curved between said feeding means and said first rotary member;

wherein an urging force of said first rotary member by which the sheet is urged against said regulating member is set to be smaller than an urging force of said second rotary member by which the sheet is urged against said regulating member.

2. A sheet feeding apparatus according to claim 1, further including a third rotary member cooperating with said first and second rotary members to feed the sheet.

3. A sheet feeding apparatus according to claim 1, wherein said second rotary is disposed in an inclined condition with respect to said regulating member.

4. A sheet feeding apparatus according to claim 3, wherein said first rotary is disposed in an inclined condition with respect to said regulating member.

5. A sheet feeding apparatus according to claim 4, wherein an inclined angle of said first rotary member is smaller than that of said second rotary member.

6. A sheet feeding apparatus according to claim 2, wherein said guide means guides the sheet along an outer peripheral surface of said third rotary member.

7. A sheet feeding apparatus according to claim 1, wherein said feeding means includes a supply means for feeding out the sheet from a sheet stack.

8. A sheet feeding apparatus, comprising:

a. a stacking means for stacking sheets;

b. a first regulating member for regulating positions of lateral edges of the sheets stacked on said stacking means;

c. a supply means for supplying a sheet from the sheets stacked on said stacking means;

d. a second regulating member for regulating a position of the lateral edge of the sheet supplied by said supply means;

e. a first rotary member disposed at a downstream side of said supply means in a sheet feeding direction and adapted to feed the sheet fed by said supply means while urging said lateral edge of the sheet against said second regulating member;

f. a second rotary member disposed at a downstream side of said first rotary member in the sheet feeding direction and adapted to feed the sheet fed by said first rotary member while urging said lateral edge of the sheet against said second regulating member; and g. a guide means for guiding the sheet in such a manner that the sheet is curved between said supply means and said first rotary member;

wherein an urging force of said first rotary member, by which the sheet is urged against said second regulating member, is set to be smaller than an urging force of said second rotary member, by which the sheet is urged against said second regulating member, and wherein a regulating surface of said second regulating member is displaced outwardly from that of said first regulating member with respect to the lateral edge of the sheet to be regulated.

9. A sheet feeding apparatus according to claim 8, wherein said second rotary is disposed in an inclined condition with respect to said second regulating member.

10. A sheet feeding apparatus according to claim 8, wherein said second rotary is disposed in an inclined condition with respect to said second regulating member.

11. A sheet feeding apparatus according to claim 10, wherein said first rotary is disposed in an inclined condition with respect to said second regulating member.

12. A sheet feeding apparatus according to claim 11, wherein an inclined angle of said second rotary member is greater than that of said first rotary member.

13. A sheet feeding apparatus according to claim 8, wherein said first and second regulating means guide the same lateral edge of the sheet.

14. A sheet feeding apparatus, comprising:

a. a feeding means for feeding a sheet;

b. a regulating member for regulating a position of a lateral edge of the sheet fed by said feeding means;

c. a first rotary member disposed at a downstream side of said feeding means in a sheet feeding direction and adapted to feed the sheet fed by said feeding means while urging said lateral edge of the sheet against said regulating member;

d. a second rotary member disposed at a downstream side of said first rotary member in the sheet feeding direction and adapted to feed the sheet fed by said first rotary member while urging said lateral edge of the sheet against said regulating member; and e. a guide for guiding the sheet in such a manner that the sheet is curved between said feeding means and said first rotary member;

wherein an urging force of said first rotary member, by which the sheet is urged against said regulating member, is set to be smaller than an urging force of said second rotary member, by which the sheet is urged against said regulating member, and wherein a sheet feeding direction of said feeding means is opposite to a sheet feeding direction of said first rotary member.

15. A sheet feeding apparatus according to claim 14, wherein said first rotary member is disposed in an inclined condition with respect to said regulating member.

16. A sheet feeding apparatus according to claim 15, further including a third rotary member disposed at a downstream side of said first rotary member and adapted to feed the sheet while urging the sheet against said regulating member.

17. A sheet feeding apparatus, comprising:

a feeding means for feeding a sheet;

a regulating member for regulating a position of a lateral edge of the sheet fed by said feeding means;

a first rotary member disposed at a downstream side of said feeding means in a sheet feeding direction and adapted to feed the sheet fed by said feeding means while urging the sheet against said regulating member; and a second rotary member disposed at a downstream side of said first rotary member in the sheet feeding direction and adapted to feed the sheet fed by said first rotary member while urging the sheet against said regulating member;

wherein an urging force of said first rotary member by which the sheet is urged against said regulating member is set to be smaller than an urging force of said second rotary member by which the sheet is urged against said regulating member.

18. A sheet feeding apparatus according to claim 17, further including a third rotary member cooperating with said first and second rotary members to feed the sheet.

19. A sheet feeding apparatus according to claim 18, wherein said second rotary is disposed in an inclined condition with respect to said regulating member.

20. A sheet feeding apparatus according to claim 19, wherein said first rotary is disposed in an inclined condition with respect to said regulating member.

21. A sheet feeding apparatus according to claim 20, wherein an inclined angle of said first rotary member is smaller than that of said second rotary member.

22. A sheet feeding apparatus according to claim 18, wherein said guide means guides the sheet along an outer peripheral surface of said third rotary member.

23. A sheet feeding apparatus according to claim 18, wherein said feeding means includes a supply member for feeding out the sheet from a sheet stack.

24. An image forming system, comprising:
a feeding means for feeding a sheet;
a regulating member for regulating a position of a lateral edge of the sheet fed by said feeding means;
a first rotary member disposed at a downstream side of said feeding means in a sheet feeding direction and adapted to feed the sheet fed by said feeding means while urging the sheet against said regulating member;
a second rotary member disposed at a downstream side of said first rotary member in the sheet feeding direction and adapted to feed the sheet fed by said first rotary member while urging the sheet against said regulating member;
a guide means for guiding the sheet in such a manner that the sheet is curved between said feeding means and said first rotary member; and
an image forming means for forming an image on the sheet fed by said second rotary member;
wherein an urging force of said first rotary member by which the sheet is urged against said regulating member is set to be smaller than an urging force of said second rotary member by which the sheet is urged against said regulating member.

25. An image forming system, comprising:
a. a stacking means for stacking sheets;
b. a first regulating member for regulating positions of lateral edges of the sheets stacked on said stacking means;
c. a supply means for supplying a sheet from the sheets stacked on said stacking means;
d. a second regulating member for regulating a position of the lateral edge of the sheet supplied by said supply means;
e. a first rotary member disposed at a downstream side of said supply means in a sheet feeding direction and adapted to feed the sheet fed by said supply means while urging said lateral edge of the sheet against said second regulating member;
f. a second rotary member disposed at a downstream side of said first rotary member in the sheet feeding direction and adapted to feed the sheet fed by said first rotary member while urging said lateral edge of the sheet against said second regulating member; and
g. a guide means for guiding the sheet in such a manner that the sheet is curved between said supply means and said first rotary member; and
h. an image forming means for forming an image on the sheet fed by said supply means;
wherein an urging force of said first rotary member, by which the sheet is urged against said second regulating member, is set to be smaller than an urging force of said second rotary member, by which the sheet is urged against said second regulating member, and
wherein a regulating surface of said second regulating member is displaced outwardly from that of said first regulating member with respect to the lateral edge of the sheet to be regulated.

26. An image forming system, comprising:
a. a feeding means for feeding a sheet;
b. a regulating member for regulating a position of a lateral edge of the sheet fed by said feeding means;
c. a first rotary member disposed at a downstream side of said feeding means in a sheet feeding direction and adapted to feed the sheet fed by said feeding means while urging said lateral edge of the sheet against said regulating member;
d. a second rotary member disposed at a downstream side of said first rotary member in the sheet feeding direction and adapted to feed the sheet fed by said first rotary while urging said lateral edge of the sheet against said regulating member; and
e. a guide for guiding the sheet in such a manner that the sheet is curved between said feeding means and said first rotary member; and
f. an image forming means for forming an image on the sheet fed by said first rotary member;
wherein an urging force of said first rotary member, by which the sheet is urged against said regulating member, is set to be smaller than an urging force of said second rotary member, by which the sheet is urged against said regulating member, and
wherein a sheet feeding direction of said feeding means is opposite to a sheet feeding direction of said first rotary member.

27. An image forming system, comprising:
a feeding means for feeding a sheet;
a regulating member for regulating a position of a lateral edge of the sheet fed by said feeding means;
a first rotary member disposed at a downstream side of said feeding means in a sheet feeding direction and adapted to feed the sheet fed by said feeding means while urging the sheet against said regulating member;
a second rotary member disposed at a downstream side of said first rotary member in the sheet feeding direction and adapted to feed the sheet fed by said first rotary member while urging the sheet against said regulating member; and
an image forming means for forming an image on the sheet fed by said second rotary member;
wherein an urging force of said rotary member by which the sheet is urged against said regulating member is set to be smaller than an urging force of said second rotary member by which the sheet is urged against said regulating member.

28. A sheet feeding apparatus, comprising:
stack means for stacking sheets thereon;
sheet supply means for supplying a sheet from the sheets stacked on said stack means;
a separation pawl abutting one side area of a leading edge of the sheets stacked on said stack means to separate the sheets one by one by cooperating with said sheet supply means;
a guide for regulating a position of a lateral edge of the sheet supplied by said sheet supply means, said lateral edge and a side portion of the supplied sheet being located at the same side;
first feed means for feeding the sheet by contacting with the sheet at he side portion located at the same side as the lateral edge to urge the sheet toward said guide by a first predetermined force; and
second feed means for feeding the sheet by contacting with the sheet at the side portion located at same the side as the lateral edge to urge the sheet toward said guide by a second predetermined force larger than the first predetermined force.

29. A sheet feeding apparatus according to claim 28, wherein said first feed means has a first rotary member disposed in an inclined condition.

30. A sheet feeding apparatus according to claim 29, wherein said second feed means has a second rotary member disposed in an inclined condition.

31. A sheet feeding apparatus according to claim 30, wherein the inclined angle of said first rotary member is smaller than that of said second rotary member.

32. A sheet feeding apparatus according to claim 31, further comprising a third rotary member for feeding the sheet cooperating with said first and second rotary members.

33. A sheet feeding apparatus according to claim 32, further comprising guide means for guiding the sheet while beinding along said third rotary member.

34. A sheet feeding apparatus according to claim 28, wherein said sheet supply means contacts an end portion of a side of the sheets stacked on said stack means where said separation pawl contacts the sheets.

* * * * *

UNITED STATES PATENT AND TRADEMARK OFFICE

CERTIFICATE OF CORRECTION

PATENT NO. : 5,284,333

DATED : February 8, 1994

INVENTOR(S) : NORIYOSHI ISHIKAWA

It is certified that error appears in the above-indentified patent and that said Letters Patent is hereby corrected as shown below:

Title page, under "FOREIGN PATENT DOCUMENTS", line 10, "63-00043 12/1988 Japan" should read --63-300043 12/1988 Japan--.

Column 1,
Line 12, "equipments" should read --equipment--;
Line 22, "convenience'" should read --convenience--; and
Line 47, "on" should read --an--.

Column 2,
Line 20, "has" should read --have--;

Line 58, "there" should read --it--.

Column 3,
Line 50, "bent." should read --bend--.

Column 4,
Line 56, "synchronous" should read --synchronism--.

UNITED STATES PATENT AND TRADEMARK OFFICE

CERTIFICATE OF CORRECTION

PATENT NO. : 5,284,333
DATED : February 8, 1994
INVENTOR(S) : NORIYOSHI ISHIKAWA It is certified that error appears in the above-indentified patent and that said Letters Patent is hereby corrected as shown below:

Column 5,
Line 65, "roller 26" should read --roller 25--.

Column 7,
Line 33, "synchronous" should read --synchronism--.

Column 8,
Line 67, "second rotary" should read --second rotary member--.

Column 9,
Line 2, "first rotary" should read --first rotary member--; and
Line 57, "first rotary" should read --first rotary member--.

Column 10,
Line 54, "claim 18," should read --claim 17,--; and
Line 58, "first rotary" should read --first rotary member--.

UNITED STATES PATENT AND TRADEMARK OFFICE

CERTIFICATE OF CORRECTION

PATENT NO. : 5,284,333
DATED : February 8, 1994
INVENTOR(S) : NORIYOSHI ISHIKAWA It is certified that error appears in the above-indentified patent and that said Letters Patent is hereby corrected as shown below:

Column 12,
Line 6, "first rotary" should read --first rotary member--;
Line 59, "same" should read --the--; and
Line 60, "the" (1st occurrence) should read --same--.

Column 14,
Line 2, "beinding" should read --bending--.

Signed and Sealed this

Thirteenth Day of September, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,284,333
DATED : February 8, 1994
INVENTOR(S) : NORIYOSHI ISHIKAWA It is certified that error appears in the above-indentified patent and that said Letters Patent is hereby corrected as shown below:

Column 10:

line 54, change "claim 18," to --claim 17,--; and
line 55, change "said second rotary" to --said second rotary member--.

Signed and Sealed this

Twenty-first Day of March, 1995

*Attest:*

Bruce Lehman

BRUCE LEHMAN

*Attesting Officer*

*Commissioner of Patents and Trademarks*